US006274832B1

(12) United States Patent
Tachibana

(10) Patent No.: US 6,274,832 B1
(45) **Date of Patent: *Aug. 14, 2001**

(54) SWITCH ACTUATORS FOR TOYS

(75) Inventor: Toshihisa Tachibana, Kanagawa (JP)

(73) Assignee: Alfa Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/349,210

(22) Filed: Jul. 7, 1999

(30) Foreign Application Priority Data

Oct. 30, 1998 (JP) ..... 10-310099

(51) Int. Cl.[7] ..... H01H 21/26
(52) U.S. Cl. ..... 200/343; 335/207
(58) Field of Search ..... 200/343; 335/205, 335/207

(56) References Cited

U.S. PATENT DOCUMENTS 3,644,856 * 2/1972 Scott ..... 335/207
3,681,723 * 8/1972 Goll ..... 335/207
4,172,217 * 10/1979 Miller ..... 200/343 X
4,845,319 * 7/1989 Watkins et al. ..... 200/343 X

FOREIGN PATENT DOCUMENTS 6-44866 * 2/1994 (JP) ..... 200/343

* cited by examiner

*Primary Examiner*—Renee Luebke
(74) *Attorney, Agent, or Firm*—Richard M. Goldberg

(57) ABSTRACT

A switch actuator for toys comprising two plates 1 which are joined together at one end thereof with a hinge. One of the two plates 1 has an electric circuit 2 to generate electric signals to produce sounds and/or other output. The other plate 1 has a contact switch 3 to energize the electric circuit 2. Either or both of the two plates 1 have a projection 5 or a catch 6. An elastic device or a pair of magnets 4 are interposed between the two plates 1 to keep them apart from each other. The switch actuator thus arranged is simple and solid and prevents accidental completion of the electric circuit that sometimes occur during the out-of-service periods.

1 Claim, 4 Drawing Sheets

Fig. 1
Fig. 1(a)
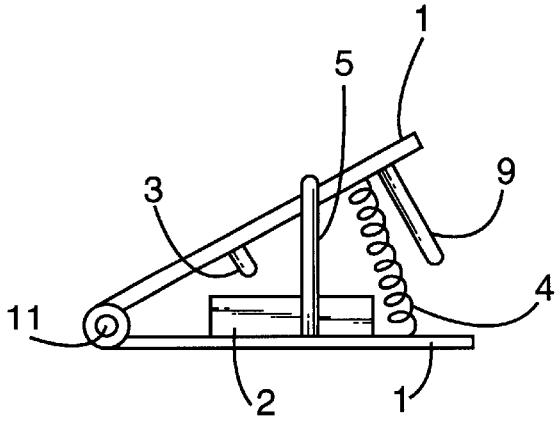
Fig. 1(b)
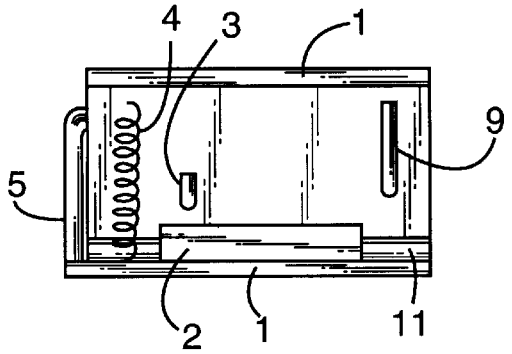
Fig. 2
Fig. 2(a)
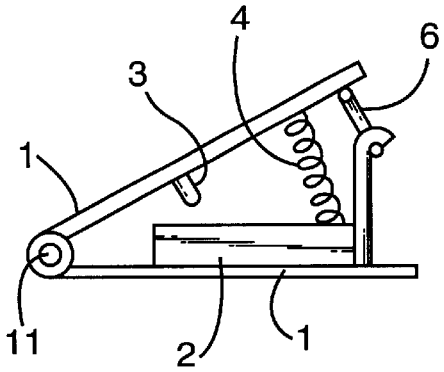
Fig. 2(b)
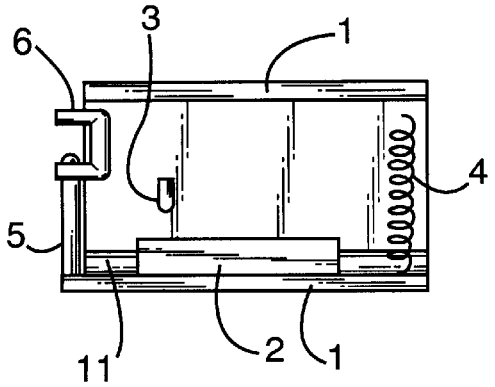

SWITCH ACTUATORS FOR TOYS

BACKGROUND OF THE INVENTION

This invention relates to actuating devices having a switch to actuate electric circuits for triggering sounds, lights, and/or motion for amusement devices incorporated in stuffed dolls and other types of toys.

Many types of devices have been developed for toys to generate sounds, light and/or motion by actuating a switch. In these devices, the switch is an indispensable component part.

With stuffed dolls with which such actuating electric circuits are often used, however, most switches must be of the contact type, and not of the non-contact type, because of design-budget limits. When any device containing a contact switch comes in contact with some external article during storage or transportation, the contact switch might be pressed and closes to energize an electric circuit resulting in a waste of electricity from the dry cells.

To eliminate this problem, an invention according to Japanese Patent No. 2643748 (hereinafter referred to as the prior art), for example, puts said electric circuit and switch in a housing having two partitioned segments. The two segments are normally at a given distance from each other by means of a spring or other similar type device interposed therebetween. The design is such that the switch closes to energize the electric circuit when any external force acts to bring the two segments closer. The two segments are supported by means of multiple slots cut in one of the two segments and a corresponding number of projections formed on the other segment and adapted to be movable in said slots. A combination of the slots and projections permits relative motion between the two segments within the limits of the original and second smaller distance.

The prior art is excellent in that it eliminates an unwanted motion of the switch. However, the multiple slots and projections are vulnerable to becoming disengaged and make the whole structure complex.

The object of this invention is to provide switch actuators for toys free from the problems and shortcomings in the conventional technologies and prior art described earlier.

SUMMARY OF THE INVENTION

This invention achieves the above object by providing:

(1) A switch actuator for toys comprising a first plate and a second plate joined together at one end thereof with a hinge;

the first plate comprising an actuatable electric circuit to generate electric signals to produce at least one of sound, light and/or motion;

The second plate comprising a switch closer to actuate the electric circuit;

either one of the first or second plates comprise a key-shaped projection for engaging the other plate to limit the angle that the plates move apart from each other, thereby defining the largest angle through which the plates rotate;

either one of the first and second plates comprise a second projection to prevent the two plates from approaching each other beyond a minimum distance, thereby defining the smallest angle through which the plates rotate;

an elastic device or a pair of magnets interposed between the plates to urge the plates away from each other; whereby, the hinged plates remain apart from each other at maximum angular distance defined by said key-shaped projection when no external force acts on the plates and approach each other until an angular distance corresponding to the smallest angle defined by said second projection, or at a certain intermediate point between said two angular distances, when an external force is applied to bring the plates closer, whereupon said contact switch is closed to actuate said electric circuit.

(2) A switch actuator for toys comprising a first plate and a second plate joined together at one end thereof with a hinge;

the first plate comprising an actuatable electric circuit to generate electric signals to produce at least one of sound, light and motion;

the second plate comprising a switch closer to actuate the electric circuit;

either the first or second plate comprises a pair of catches wherein a first catch defines the largest angle of rotation of the plates about the hinge and a second catch defines the smallest angle of rotation of the plates about the hinge, the plate which does not comprise the pair of catches comprise a key-shaped projection adapted to move between and engage with the pair of catches;

an elastic device or a pair of magnets interposed between the plates to urge the plates away from each other; whereby, the hinged plates remain apart from each other at a maximum angular distance defined by the key-shaped projection and said first catch when no external force acts on the plates and approach each other until an angular distance corresponding to the smallest angle defined by the second catch, or at a certain intermediate point between the two angular distances, when an external force is applied to bring the plates closer whereupon the contact switch is closed to actuate the electric circuit.

The switch closer can be a push or pull means which applies pressure to close the switch or a contact of the switch itself as shown in FIG. 4.

BRIEF DESCRIPTION OF THE DRAWINGS

FIG. 1 shows a switch actuator of type (1); FIG.1 (*a*) is a side elevation showing a condition in which the two plates are at the largest angular distance, and FIG. 1(*b*) is a front elevation showing a condition in which the two plates are at the largest angular distance.

FIG. 2 shows a switch actuator of type (2); FIG. 2(*a*) is a side elevation showing a condition in which the two plates are at the largest angular distance, FIG. 2(*b*) is a front elevation showing a condition in which the two plates are at the largest angular distance.

FIG. 3(*a*) illustrates an embodiment of the type (1), whereas FIG. 3(*b*) illustrates an embodiment of the type (2).

DETAILED DESCRIPTION OF THE INVENTION

Figure 3A:
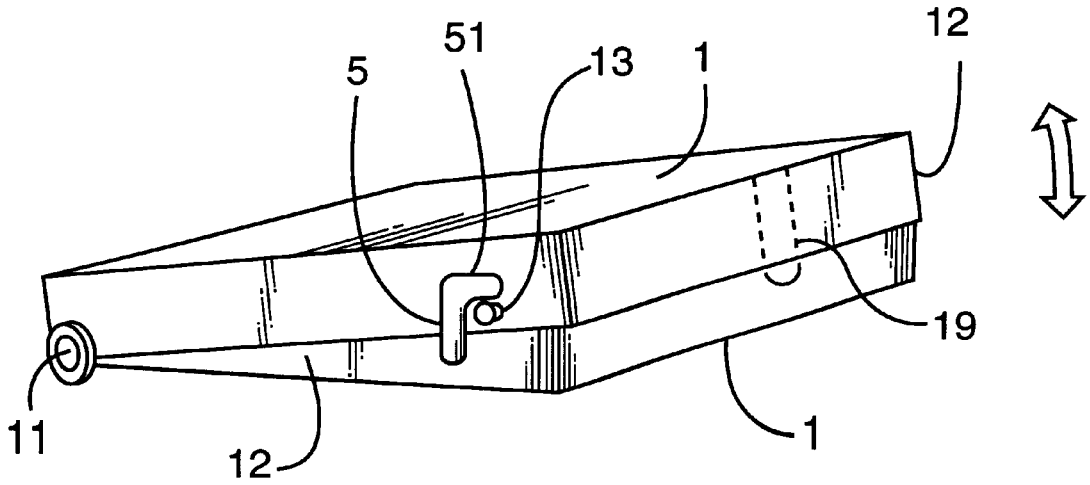
FIG. 3 illustrates a view in perspective of preferred embodiments of the invention.

FIGS. 1(*a*) and 1(*b*) and FIGS. 2(*a*) and 2(*b*) show the structures (1) and (2) of switch actuators according to the invention described earlier. As can be seen, two plates 1 are pivotally hinged together (11) at one end thereof. Maximum and minimum angles of rotation of the two plates 1 are defined by means of a key-shaped projection 5 and projection 9 (which are provided in the structure (1)) or a pair of catches 6 and a key-shaped projection 5 that is adapted to move between the two catches (which are provided in the structure (2)). An electric circuit 2 is broken when the two plates 1 are urged apart from each other at an angular distance corresponding to the maximum angle by an elastic device 4 or a pair of magnets 14 normally applying a force to urge the plates outward.

When an external force to bring together the separated two plates 1 is applied, a switch closer 3 closes the electric circuit 2 to cause the triggering 4 electric signals to produce sounds, lights and/or motions when the angular distance therebetween is reduced to a minimum or at a certain intermediate point between the maximum and minimum angles. (In FIGS. 1 and 2, the elastic device 4 normally applies a force to hold the two plates apart from each other.)

In the structure (1) shown in FIG. 1(*a*) and FIG. 1(*b*), the key-shaped projection 5 defines the maximum angle of rotation by coming into contact with the outer surface of one of the two plates 1. However, the point of contact of the key-shaped projection 5 need not always be confined to the outer surface of one of the two plates 1 (as will be described later with reference to Embodiment 2).

In FIG. 1, the projection 5 defines the maximum and projection 9 defines the minimum angles of rotation and are arranged on different plates. However, the projections S and 9 can also define the maximum and minimum angles of rotation when arranged on the same plate 1.

In the structure of embodiment (2) shown in FIG. 2(*a*) and FIG. 2(*b*), a pair of catches 6 are provided on one shaft.

Figure 4:
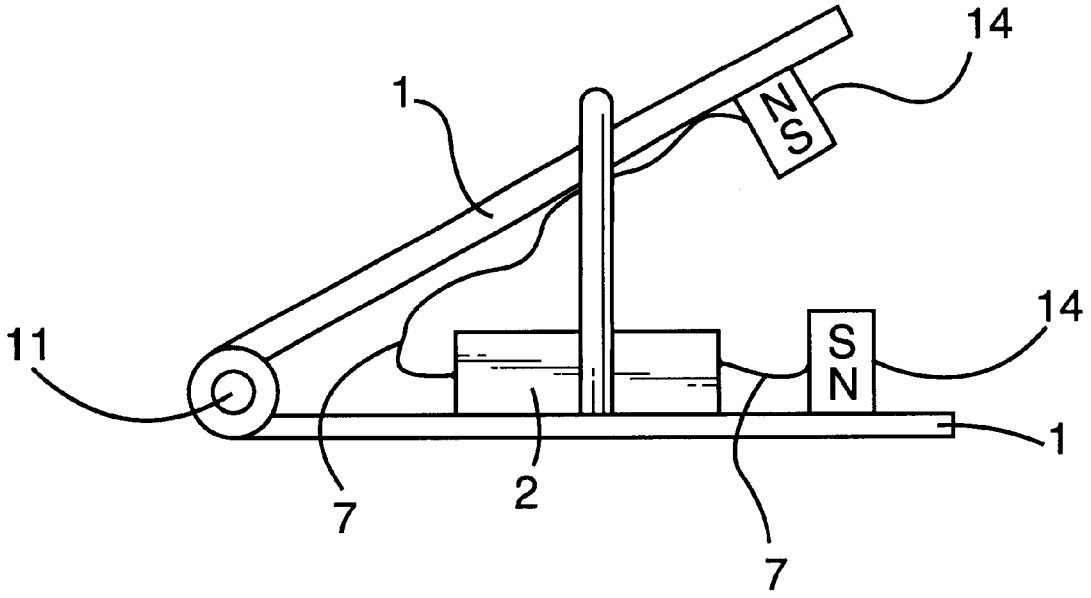
FIG. 4 is a side elevation of another preferred embodiment.

FIGS. 1 and 2 show the switch closer 3 that pushes the top surface of an actuating circuit 2. However, the switch closer 3 need not be limited to the push type. The switch closer 3 may be, for example, of a type that comes into contact with a side of the actuating circuit 2 or a contact of the circuit as shown in FIG. 4.

When out of service, the elastic device 4 or the pair of magnets 14 apply a force to urge the two plates 1 apart from each other at the maximum angular distance. Consequently, the switch closer 3 does not close the electric circuit 2 by error.

The prior art has two segments that are joined together by means of multiple slots and a corresponding number of projections. The slots and projections make the whole structure complex, unstable and vulnerable to becoming disengaged. By comparison, the two plates used in this invention are hinged together securely so that there is no risk of their becoming disengaged.

Furthermore, this invention defines the maximum and minimum angles of rotation by a combination of the key-shaped projection 5 and projection 9 (in the structure (1)) or a combination of the pair of catches 6 and the key-shaped projection 5 adapted to move therebetween (in the structure (2)). As such, this invention achieves the same action and result with a simpler structure.

In this invention, in addition, the relatively powerful elastic device 4 or pair of magnets 14 normally urge the two plates 1 apart at the maximum angular distance. Even so, the two plates 1 can be moved toward a position where they are at the minimum angular distance from each other with a relatively smaller force by using the principle of the lever.

Although the size and shape of the two plates 1 need not be limited, it is preferable that the two plates 1 are of the same shape and size.

EMBODIMENTS

Figure 3B:
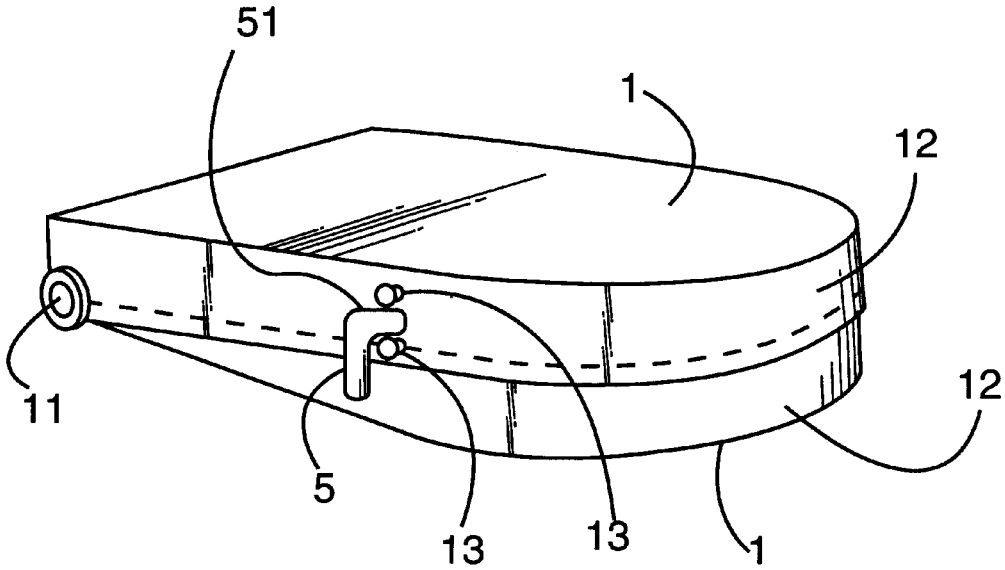

FIGS. 3(*a*) and (*b*) show preferred embodiments of the structures (1) and (2) described above. In these embodiments, the plates 1 have side frames 12 enclosing all sides thereof, with the side frame 12 on one plate 1 being adapted to fit in the side frame 12 on the other plate 1. (In FIGS. 3(*a*) and (*b*), the actuating circuit and elastic device or magnets are not shown.)

Thus, the circuit 2 and circuit closer 3 are enclosed by the side frames 12 that inhibit the intrusion of dust, dirt and other particles that might prevent the smooth operation of the circuit closer 3 and circuit 2.

The projection 9 insures the minimum angle of rotation in the structure (1) is similar to those shown in FIGS. 1 (*a*) and (*b*). However, the key-shaped projections 5, to maintain the maximum angle of rotation, need not always come into contact with the outer surface of one of the two plates 1 as shown in FIGS. 1 (*a*) and (*b*). Instead, the-key-shaped projections 5 may also maintain the maximum angle of rotation by coming into contact with one or two catches 6 provided on one of the side frames 12.

In the structure of embodiments (2), a pair of catches 13 can be provided on one of the side frames 12.

FIG. 4 shows another embodiment which urges the two plates 1 apart from each other and the maximum angular distance by using magnets 14 in place of the elastic device. When the two magnets 14 come into contact with each other, the circuit 2 is completed.

Magnets are composed of metals comprising iron or nickel and have electrical conductivity. Therefore, the circuit is completed when the two magnets come into contact with each other. In this case, one of the magnetic contacts acts as a switch closer 3.

In the second preferred embodiment, the two magnets 14, electric circuit 2 and a power supply are connected by wiring 7, whereby the magnet 14 on one of the two plates 1 functions also as the switch closer 3.

The minimum angle of rotation is attained when the magnet 14 on one of the two plates 1 comes into contact with the magnet 14 on the other plate. Therefore, the magnets 14 can serve also as the projection to insure the minimum angle of rotation.

Accordingly, the second embodiment conforms more to the structure (1) than to the structure (2).

As described above, this invention provides switch actuators of simple structures that prevent unwanted completion of the electric circuit by accidental closing of the switch that sometimes occurs during the out-of-service periods. The switch actuators according to this invention are simpler and more solid than those shown in the prior art.

The second embodiment in particular is very convenient in that the magnets function as the switch closer and the projection to maintain the minimum angle of rotation.

As can be understood from the above, this invention has many advantages and is of great value.

Figure 5:
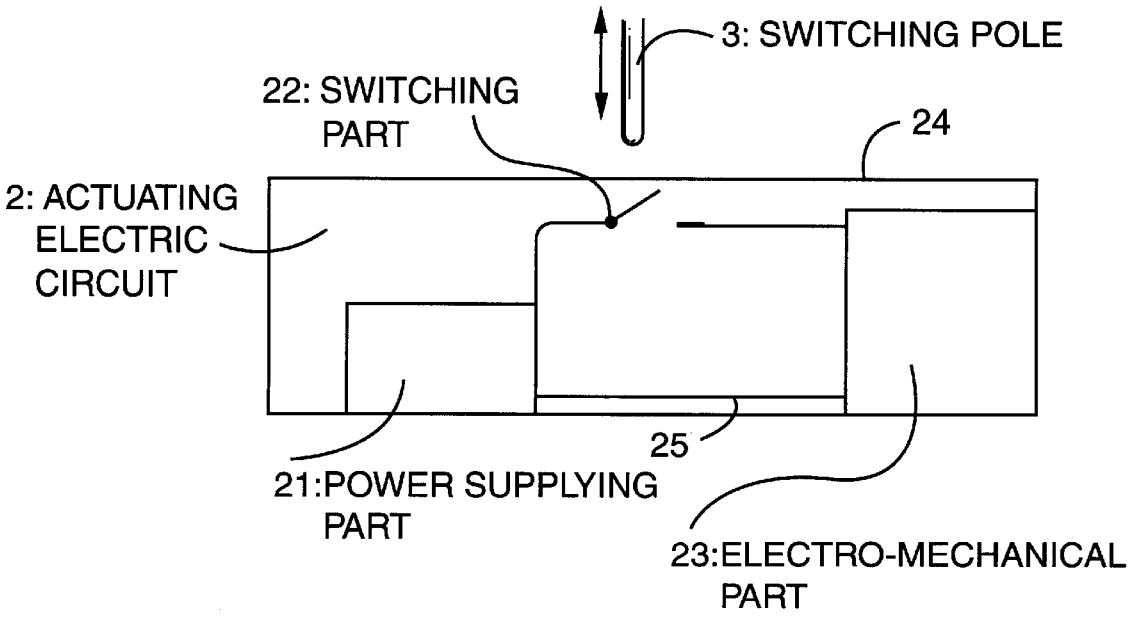
FIG. 5 is a schematic illustration of the electrical circuit of the invention.

FIG. 5 is a schematic illustration of the electric circuit of the device of the embodiments shown in FIGS. 1, 2 and 3. The actuating circuit 2 is generally enclosed in an enclosure 24 having at least a yieldable portion in the area of switching part 22. A power supply 21 and electromechanical device 23 are arranged in enclosure 24 and are brought into electrical communication by closure of switch 22 by pressure of switch closer 3. Electrical connector 25 completes the electric circuit between the power supply 21 and electromechanical device 23. It is preferred that the actuating electrical circuit 2 be enclosed in enclosure 24 to permit the electric contacts and electromechanical device be maintained free of debris and interference from the internal material of the device within which the switch activator is arranged.

What is claimed is:

1. A switch actuator for toys comprising.

a first plate;

a second plates;

a hinge for joining together said first plate and said second plate at one end thereof;

the first plate including an actuatable electric circuit to generate electric signals to produce at least one of sound, light and motion;

the second plate including a switch closer to actuate said electric circuit upon rotation of said second plate relative to said first plate about said hinge by a predetermined angle;

one of the first and second plates including a pair of catch extensions such that a first catch extension extends outwardly from an outer surface of the respective plate and defines a maximum angle of rotation of said two plates about the hinge and a second catch extension extends outwardly from the outer surface of the respective plate in spaced relation from the first catch extension and defines a minimum angle of rotation of said two plates, the other plate including a key-shaped projection fixed thereto and extending from an outer surface thereof, said projection having a hook element positioned between the first and second catch extensions and adapted to move between and engage with said pair of catch extensions; one of:

an elastic device, and a pair of magnets interposed between the plates to urge the plates away from each other, the hinged plates remaining apart from each other at the maximum angular distance defined by the key-shaped projection and said first catch extension when no external force acts and approaching each other until an angular distance corresponding to the minimum angle defined by the second catch extension, when an external force is applied to bring the two plates closer, whereupon said switch closer actuates said electric circuit.

* * * * *